United States Patent [19]

Finnerty

[11] Patent Number: 5,029,810

[45] Date of Patent: Jul. 9, 1991

[54] HIGH PERFORMANCE DAMPER BLADE AND DAMPER SEAL COMBINATION

[75] Inventor: Paul J. Finnerty, Scranton, Pa.

[73] Assignee: American Standard Inc., New York, N.Y.

[21] Appl. No.: 612,017

[22] Filed: Nov. 9, 1990

[51] Int. Cl.[5] ..... F16K 1/18; F16K 1/42

[52] U.S. Cl. ..... 251/299; 251/364; 98/110

[58] Field of Search ..... 251/298, 299, 359, 364; 98/91.1, 106, 107, 110, 121.2

[56] References Cited

U.S. PATENT DOCUMENTS

| | | | |
|---|---|---|---|
| 1,272,460 | 7/1918 | Knoll | 251/364 X |
| 1,690,368 | 11/1928 | Grapp | 98/106 |
| 2,998,765 | 9/1961 | Spargo | 98/110 X |
| 3,123,098 | 3/1964 | Bishop | 137/601 |
| 3,312,242 | 4/1967 | Kahn et al. | 137/601 |
| 3,426,653 | 2/1969 | Kawamura | 98/121.2 |
| 3,447,443 | 6/1969 | Silvey | 98/110 |
| 3,530,783 | 1/1969 | Alamprese | 98/110 |
| 3,581,650 | 6/1971 | McCabe | 98/110 |
| 3,584,566 | 6/1971 | McCabe | 98/110 |
| 3,605,603 | 9/1971 | McCabe | 98/110 |
| 3,653,317 | 4/1972 | Costanzo, Jr. | 98/110 |
| 3,682,084 | 8/1972 | Tarnoff | 98/110 |
| 3,832,940 | 9/1974 | Hess | 98/110 |
| 4,193,605 | 3/1980 | Josephson | 277/184 |
| 4,766,807 | 8/1988 | Davis | 98/121.2 |

FOREIGN PATENT DOCUMENTS

| | | | |
|---|---|---|---|
| 932194 | 7/1963 | United Kingdom | 251/299 |

*Primary Examiner*—John Rivell

*Attorney, Agent, or Firm*—William J. Beres; William O'Driscoll; David L. Polsley

[57] ABSTRACT

A high performance damper blade and damper blade seal combination including a damper blade having a planar portion perpendicular to the damper blade and a damper blade seal including a base and two upwardly extending legs. One leg of the damper blade seal contacts the damper blade body, while the other leg of the damper blade seal contacts the outside edge of the perpendicular tip portion of the damper blade. The tip of the perpendicular damper blade portion contacts the base of the damper blade seal for providing a third point of contact between the damper blade and the damper seal to ensure minimum airflow through the damper blade and end seal when the damper blade is in the closed position. Furthermore, the leg of the damper seal which contacts the outer side of the blade tip portion operates advantageously as a wind break to prevent leakage through the damper blade and seal combination due to wind gusts when the damper blade and seal are employed on air handler units or air conditioning systems.

11 Claims, 1 Drawing Sheet

HIGH PERFORMANCE DAMPER BLADE AND DAMPER SEAL COMBINATION

TECHNICAL FIELD

This invention pertains generally to the field of air handling equipment and specifically to air handling equipment having air intakes including dampers with sealing means for undesired airflow prevention.

BACKGROUND ART

In a typical air handling device suitable for use in heating, ventilating and air conditioning equipment, a number of dampers are typically found to facilitate the control of the airflow through the air handler unit under varying temperature and humidity conditions. In the past, it was not atypical to find that the dampers, when in the closed position, were not sealed, and that a relatively large amount of undesired airflow would be tolerated within the HVAC equipment. However, in the more recent past, the damper blades have been provided with a seal or seals to facilitate the prevention of undesired airflow when in the closed position. This prevention of the undesired airflow has been found to improve the controllability of the air handler units so as to improve the temperature and humidity controlling abilities of the units while at the same time lowering the amount of energy required to provide the desired heating, ventilating or air conditioning effect.

Several factors must be taken into consideration when employing the damper blade seals, however. The successful damper blade seal and damper blade combination must provide ease of manufacture, low initial expense, acceptable longevity in operating life, and high efficiency in performance. Typically, it has been difficult to met these goals, with one or more of the goals being obtained at the expense of the others. In many cases the damper blade is met with a single seal of the wiper type against which the damper blade seats to obtain a seal due to compression between the seal and the blade. In other cases, damper blade seals or damper blades of relatively complex confirmation are provided so that line contact sealing may be made at more than one point. While these damper blade seals are higher performance, they are often more expensive and involve a relatively large number of steps in the manufacture, and consequently drive up the cost of the air handling unit undesirably.

It is therefore an object of the invention to provide a damper blade and damper blade seal combination which provides for high performance sealing efficiency to prevent undesired airflow when the damper blade is in the closed position.

It is another object of the invention to provide such damper blade seal as will provide multiple line sealing engagement between the damper blade and the damper blade seal when in the closed position to reduce susceptibility of the damper blade seal and damper blade combination to undesired airflow during windy or gusty conditions when employed in an air handler unit.

It is another object of the present invention to provide such a damper blade seal and damper blade combination as is inexpensive and easy to manufacture.

It is another object of the invention to provide such a damper blade seal and damper blade combination as will provide suitable longevity of operation in the air handler unit in which it is employed.

SUMMARY OF THE INVENTION

The subject invention is a damper blade seal and damper blade combination. The damper blade includes a tip portion which is planar, and angled with respect to the body of the damper blade, and the damper blade seal includes a base portion having two upwardly extending legs at each side of the base so as to form a channel. The base of the damper blade seal is affixed to the air handler along a line which is parallel to and removed from the axis about which the damper blade rotates so that the tip of one upwardly extending leg engages the damper blade body proper, while the tip of the damper blade tip portion engages the base of the damper blade seal and the other leg of the damper blade seal engages the side of the damper blade tip portion. The damper blade and damper seal thereby provide three lines of sealing contact between the damper blade and the damper seal to ensure suitable sealing of the opening across which the damper blade is disposed in the closed position when employed in an air handling unit.

DESCRIPTION OF THE PREFERRED EMBODIMENT

Figure 1:
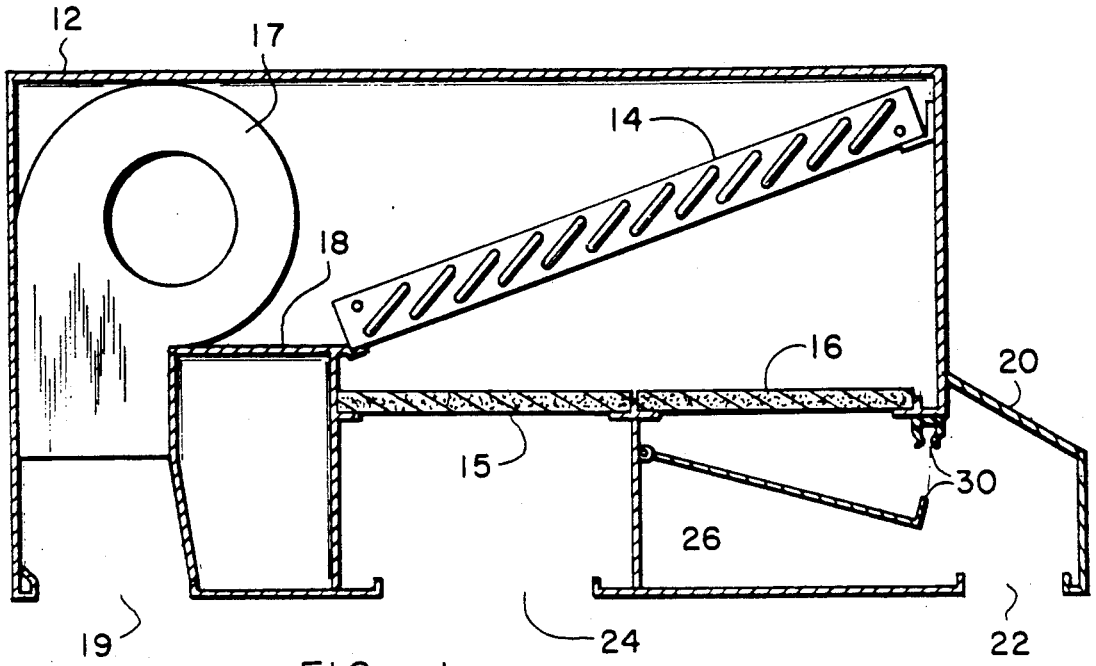
FIG. 1 shows a cross-sectional perspective view of an air handler unit incorporating the damper blade and damper seal according to the present invention.

An air handler unit generally referred to by reference numeral 10 is shown in FIG. 1. The air handler unit 10 is of the type commonly found in central air conditioning systems having a duct-work system providing conditioned air to a number of rooms or conditioned spaces, and a duct-work system for returning air from the rooms or conditioned spaces to the air handler unit is typically included in such systems. The duct-work systems and conditioned spaces typically associated with the air handler unit 10 are not shown herein, as such systems are believed to be well understood and known to those skilled in the relevant art. However, the typical duct-work system is installed above a false ceiling over the room or conditioned spaces and below the roof or ceiling, as the case may be, above the false ceiling. The air handler unit 10 is then typically installed in connection with the duct-work system, often upon the roof of the conditioned structure, to provide a source of ventilating air, and to condition the air within the structure.

Figure 2:
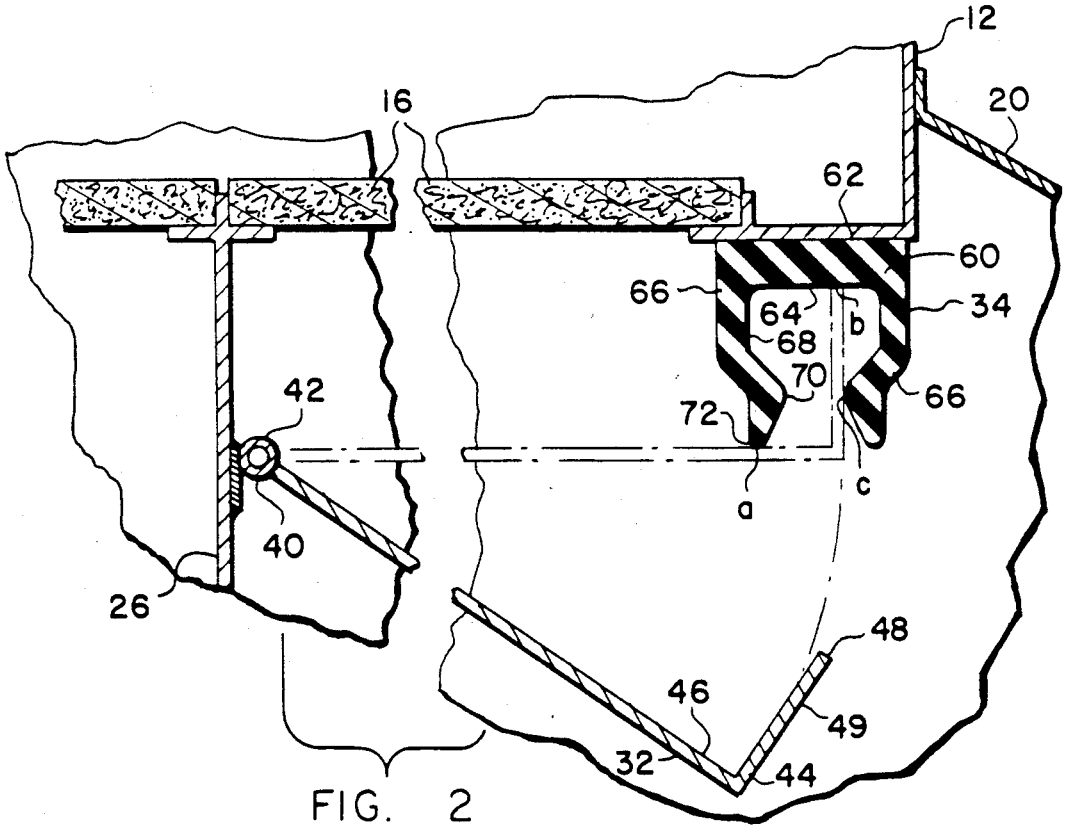
FIG. 2 discloses an enlarged cross-sectional view of the damper blade and damper seal as shown in FIG. 1.

The air handler unit 10, as shown in FIGS. 1 and 2, consists generally of an enclosure 12 with a heat exchanger coil 14 disposed therein. A return air filter 15 and fresh air filter 16 are disposed on one side of the heat exchange coil 14 and a centrifugal fan 17 is disposed on the opposite side of the heat exchanger coil 14 to draw the air through the filters 15 and 16 and the heat exchange coil 14. A partition joins the centrifugal fan 17, the heat exchange coil 14 and the enclosure 12 to define an airflow passage within the enclosure 12. A hood 20 extends from the enclosure 12 and defines a supply air aperture 22 through which fresh air may enter the enclosure 12. A return air aperture 24 is also defined in the enclosure 12, at which the duct-work is connected to provide a flow of return air into the air handler 10. A partition 26 is disposed within the enclosure 12 to separate the return airflow and the supply airflow prior to the filters 15 and 16.

A damper assembly 30 is provided within the enclosure 12 to control the amount of supply air provided through the supply air aperture 22 and hence the proportion of return air and supply air provided by the air handler unit 10 through the aperture 19.

Turning more particularly to FIG. 2, the damper assembly 30 is disclosed in greater detail. The damper blade assembly 30 includes a damper blade 32 and a damper blade seal 34. The damper blade 32 includes a hinge end 40 which is secured to an actuator rod 42. The actuator rod 42 extends from side to side within the enclosure 12 along the partition 26 and is parallel to the fresh air filter 16. At the opposite end of the damper blade 32 is a damper blade end portion 44. Preferably, the damper blade end portion 44 is integral with and angled with respect to the damper blade body 32 along a line which is parallel to the actuator rod 42 so that the damper blade end portion 44 extends perpendicularly from the damper blade body 32 toward the damper blade seal 34. The damper blade 32 also includes an inner surface 46, a seal engaging end 48 and a seal engaging face 49 on the perpendicular portion 44. As shown, the damper blade body 32 is planar or substantially planar as well, however, it will be apparent to those skilled in the relevant art that the damper blade body 32 may be formed to include corrugations or depressions or other slight regular or irregular alterations in its form so as to increase its resistance to bending and deformation in use.

The damper blade seal 34 includes a base portion 60 having an outside face 62 which is disposed on and secured to the enclosure 12. The damper blade seal 34 is preferably retained thereto by means of an adhesive, although many other equally suitable means are readily available. The base portion 60 also includes an interior sealing surface 64 for engaging the sealing end 48 of the damper blade 32. The damper blade seal 34 also preferably includes two symmetric upstanding legs 66. Each upstanding leg 66 includes an inward facing surface, the leg inner face 68, which preferably includes a protuberance 70 and a tip portion 72. According to the preferred embodiment, the upstanding legs 66 are symmetric, disposed at opposite sides of the base 60 so that the damper blade seal 34 may be disposed upon the enclosure 12 parallel to the axis of the actuating rod 42 of the damper blade 32. This permits the disposition of the damper blade seal 34 upon the enclosure 12 during manufacture without regard to which upstanding leg 66 is to be disposed closer to the filter 16, thus substantially enhancing the ease of manufacture of the damper blade assembly 30.

Those skilled in the art will recognize that the air handler unit 10 described herein is to be taken as representative rather than limiting, as the various components may be disposed within the air handler 10 according to many other suitable dispositions. Other embodiments of the air handler unit 10 and the damper blade assembly 30 will also be apparent to those skilled in the relevant art. For example, the actuator rod 42 may be fixed within the enclosure 12 so that the damper blade 32 pivots on the actuator rod 42 in response to an actuator connected directly to the damper blade 32. Also, the actuator rod 42 may be centrally disposed in the damper blade body 32, and the damper blade body 32 may be provided with oppositely extending damper blade end portions 44. In this case, two damper blade seals 34 will be situated on opposing sides in the damper blade 32 to engage the damper blade end portions 44 and thereby seal the supply air aperture 22. These examples are intended to emphasize the adaptability of the damper assembly 30 to alternative embodiments of the air handler unit 10, and are not therefore intended to be limiting.

In operation, an actuator (not shown) is used to cause the actuator rod 42 to rotate, and thus the damper blade 32 to pivot about the axis of the actuator rod 42 so as to engage in the closed position the damper blade seal 34 and disengage the damper blade seal 34 in the open position to permit airflow through the filter 16. In the closed position. sealing of the damper blade assembly 30 is provided by engagement between the inner surface 46 of the damper blade body 32 and the tip portion 72 of the upstanding leg 66 disposed closer to the filter 16, sealing contact between the sealing end 48 and the inner face 64 of the base 60, and sealing line contact between the protuberance 70 and the outer face 49 of the damper blade end portion 44. This engagement is shown by the phantom lines representing the damper blade 32 in the closed position in FIG. 2 by sealing line contact at points a, b and c, respectively, in the cross sectional view of FIG. 2.

Those skilled in the art will recognize that the damper blade assembly 30 of the present invention constitutes a substantial improvement in the art of damper blade sealing. The provision of a damper blade seal 34 which is interchangeable in installation to provide ease of manufacturing, together with a damper blade 32 having a simple conformation requiring only one perpendicular bend operation to form the perpendicular bend portion 44 comprises a substantial improvement in the ease of manufacturability of the damper blade seal assembly 30, while providing high performance and improved efficiency in sealing due to the multiple line sealing contact represented by the points A, B and C. Furthermore, those skilled in the art will recognize that the damper assembly 30 is easily and inexpensively implemented and constitutes and assembly capable of providing a suitably long operating life. It can readily be seen that the subject invention provides substantial advantages over the known prior art.

Modifications to the preferred embodiment of the subject invention will be apparent to those skilled in the art within the scope of the claims that follow hereinbelow.

What is claimed is:

1. A damper assembly for an air handler unit comprised of:

a damper blade having an open position and a closed position, said damper blade further having a damper body and a damper blade end portion;

a damper blade seal having a base and two upstanding legs extending therefrom for three liens of sealing engagement with said damper blade in the closed position, wherein one said line of sealing engagement is formed by said damper body and one of said upstanding legs, a second line of sealing engagement is formed by said damper blade end portion and said base, and a third line of sealing engagement is formed by said damper blade end portion and one of said upstanding legs.

2. The damper assembly as set forth in claim 1 wherein said damper blade end portion is planar.

3. The damper assembly as set forth in claim 2 wherein said damper blade end portion si angled with respect to said damper blade body.

4. The damper assembly as set forth in claim 3 wherein said damper assembly further includes an actuator rod having an axis, said actuator rod further being affixed to said damper blade.

5. A damper assembly for an air handler unit comprised of:

a damper blade having an open position and a closed position, said damper blade further having a damper body and a planar damper blade end portion angled with respect to said damper blade body; an actuator rod having an axis, said actuator rod affixed to said damper blade;

a damper blade seal having a base and two upstanding legs extending therefrom for three lines of sealing engagement with said damper blade int eh closed position, said damper blade seal disposed upon said air handler parallel to said axis of the actuator rod.

6. The damper assembly as set forth in claim 5 wherein said upstanding legs of said damper blade seal are symmetric and each of said upstanding legs further includes a leg inner face and a leg tip portion.

7. The damper assembly as set forth in claim 6 wherein said damper blade end portion further includes a tip for engaging in sealing line contact said damper blade seal base.

8. The damper assembly as set forth in claim 7 wherein said damper blade end portion further includes an outer face for engaging in sealing line contact said leg inner face of one said upstanding leg.

9. The damper assembly as set forth in claim 8 wherein said damper blade body further includes an inner surface for engaging in sealing line contact the tip portion of one said upstanding leg.

10. The damper assembly as set forth in claim 9 wherein said damper blade end portion is perpendicular to said damper blade body.

11. An air handler comprised of:

an enclosure defining an aperture;

an actuator rod moveably affixed within said enclosure;

a damper blade having a damper blade body including an outer face and a planar damper blade end portion integral to and angled with respect to said damper blade body, said damper blade end portion having a tip and an outer face, said damper blade secured to said actuator rod, said damper blade further having an open position to permit airflow through said aperture and a closed position to cover said aperture;

a damper blade seal having a base portion secured to said enclosure adjacent said aperture and parallel to said actuator rod, said base portion further including an interior sealing surface, said damper blade seal further including two symmetric, upstanding legs disposed at opposed sides of the base portion, each said leg including a tip portion and an inner face, so that in said closed position said damper blade tip engages in sealing line contact said interior sealing surface, said outer face of the damper blade end portion engages in sealing line contact one said leg inner face and said inner surface of the damper blade body engages in sealing line contact the tip of the other respective upstanding leg.

* * * * *